US006401363B1

(12) United States Patent
Miramondi

(10) Patent No.: US 6,401,363 B1
(45) Date of Patent: Jun. 11, 2002

(54) DRUM ASSEMBLY FOR WASHING AND DRYING MACHINES AND METHOD FOR MAKING IT

(76) Inventor: Pietro Miramondi, Via Mameli, 1, 20081 Abbiategrasso, Milano (IT)

( * ) Notice: Subject to any disclaimer, the term of this patent is extended or adjusted under 35 U.S.C. 154(b) by 0 days.

(21) Appl. No.: 09/403,574

(22) PCT Filed: Apr. 22, 1998

(86) PCT No.: PCT/IT98/00098

§ 371 (c)(1),
(2), (4) Date: Jan. 10, 2000

(87) PCT Pub. No.: WO98/48095

PCT Pub. Date: Oct. 29, 1998

(30) Foreign Application Priority Data

Apr. 24, 1997 (IT) ..... MI97A0975

(51) Int. Cl.[7] ..... F26B 11/02

(52) U.S. Cl. ..... 34/602; 34/595; 34/596; 34/599; 29/895.2; 29/509; 68/23.2; 68/24; 68/142; 134/120

(58) Field of Search ..... 34/595, 596, 599, 34/602; 29/895.2, 895.21, 509; 68/23.2, 24, 142; 134/120

(56) References Cited

U.S. PATENT DOCUMENTS 5,746,070 A * 5/1998 Bailey et al. ..... 68/24

* cited by examiner

*Primary Examiner*—Denise L. Esquivel
*Assistant Examiner*—Mark Shulman
(74) *Attorney, Agent, or Firm*—Hedman & Costigan, P.C.

(57) ABSTRACT

The present invention relates to an improved drum assembly for washing and drying machines, in which the section of the wedge elements (8) facing the drum ring (3) and provided for engaging with the latter is formed, before the drum assembling, with an edge (9) defined by an inwardly turned wall of the wedge element and parallel to the surface of the front ring (3). This front ring is in turn provided, at each wedge element (8) with a window (10) the contour of which is so deformed as to provide a deformed portion (11) adapted for firmly engaging the edge (9). The invention provides a direct mechanical coupling between the wedge elements and front ring element, i.e. a mechanical coupling which does not comprise any welding spots susceptible to favor oxidation and sealing failure problems of the made connection.

15 Claims, 6 Drawing Sheets

DRUM ASSEMBLY FOR WASHING AND DRYING MACHINES AND METHOD FOR MAKING IT

BACKGROUND OF THE INVENTION

The present invention relates to an improved drum assembly for washing, drying machines, and the like, as well as a method for making said drum assembly.

The drum assemblies of the type concerned by the present invention conventionally comprise a body of substantially drum configuration. This drum body is formed by a perforated metal band constituting the cylindric wall of the drum body, by a rear closure disc for closing the drum body, which supports the cross member supporting the shaft of the drum, and a front ring element defining the front loading mouth therethrough the cloth articles to be processed are loaded into the drum. In the case of a top loading, on the other hand, the front ring element is replaced by a closing cover, whereas the side band is provided with an opening for introducing the cloth articles into the drum.

In order to provide an efficient tumbling of the cloth articles to be washed or dried, on the inside surface of the perforated metal band forming the cylindric wall of the drum are provided a plurality of projections, having a substantially wedge-like cross section, which operate as "entrainment" elements. Actually, owing to the provision of these projections, the rotary movement applied to the drum assembly will cause the linen loaded therein to be upwardly entrained and fall by gravity, thereby aiding the washing operation.

The provision of the above mentioned projections, which will be hereinafter called "wedge elements", causes, however, problems or difficulties in properly coupling the metal band and ring element or front cover. Because of the provision of the mentioned wedge elements, in fact, the edge or rim of the mentioned metal band will have an uneven contour, which, on the other hand, must be perfectly fitted or mated with the contour of the ring element or front cover of the drum.

Prior solutions for providing such a connection include the use of spot welding operations between the respective walls of the ring or front cover element and the drum wedge elements, formed on the corresponding surface engagement portions. Such a spot welding method, however, could alter or modify the required chemical-physical properties of the drum material (chromium stainless steel, AISI 430), which is would be seriously affected by a thermal treatment like that deriving from a spot welding operation. On the other hand, this spot welding operation, which must involve a number as low as possible of regions of the drum, does not provide a connection having the desired strength and duration. In fact, the welding spots do not provide a structurally continuous connection and, moreover, as stated, could undesirably modify the drum material thereby favoring oxidation phenomena which would be very dangerous for the time stability of the performed connection.

In addition to the above mentioned drawbacks, to weld the front ring element or cover on the wedge elements of the drum is disadvantageous since it does not allow a proper centering of these elements. Actually, as the welding operation is performed, the ring or cover element can be displaced from a proper position centered with respect to the cylindric band on which they must be locked, thereby the end product may be affected by openings or undesired gaps between the connected portions.

To the foregoing it should be added that for welding the drum, additional welding materials and power are required, thereby increasing the end cost of the drim assembly.

SUMMARY OF THE INVENTION

Accordingly, the aim of the present invention is to provide such a drum assembly for washing, drying and the like machines which has a mechanical strength greater than that of commercially available like devices, mainly at the level of the mutual connection regions coupling the mentioned wedge elements and front ring or cover element.

Within the scope of the above mentioned aim, a main object of the present invention is to provide a drum assembly of the above mentioned type which is effectively devoid of any unevenness like those which occur in the connection regions of the wedge elements and the front ring or cover element in prior drum assemblies.

Yet another object of the present invention is to provide a method for making the above mentioned drum assembly, which is specifically designed for reducing to a minimum the end cost of washing, drying and the like machine drum assemblies.

According to one aspect of the present invention, the above mentioned aim and objects are achieved by an improved drum assembly for washing, drying and the like machines, of the type including a cylindric band provided with a plurality of wedge elements facing the inside of the drum assembly, a closing rear disc and a front ring element, characterized in that said drum assembly comprises connecting means for directly mechanically connecting said ring element and band, at said wedge elements of said band.

According to further features of the inventive drum assembly, said connecting means comprise projecting or raised walls provided on that section of each said wedge element engaging said ring element, said projection portions being adapted to cooperate with corresponding projecting or raised portions of said ring element. Said projecting portions, in particular, comprise a wall formed on the end of the wedge elements facing the ring element and directed inwardly of said wedge elements, at a position substantially parallel to the surface of the ring element therewith said wall must be connected. In turn, said projecting portions of said ring element comprise a deformed or upset edge or rim portion provided at the connection section on each wedge element and having such a size and shape to be housed inside each said wedge element, above and beyond the mentioned projecting wall.

According to further features of the drum assembly according to the present invention, said deformed edge or rim portion comprises a wall facing the inside of the drum assembly. After having performed the mechanical connection, the mentioned deformed edge or rim portion will be rearwardly turned and upset against said wall of the respective wedge element.

According to a modified embodiment of the drum assembly of the invention, said direct connection mechanical means comprise a portion of said wedge elements axially projecting on the outside of said cylindric band, for cooperating with a corresponding window of the front ring element, to be locked inside the latter, at the contour thereof.

The method for making the above disclosed drum assembly, which also constitutes a main aspect of the present invention, is essentially characterized in that it comprises the step of cold anchoring said front ring or cover element and cylindric band, at the wedge elements of said band. The method is moreover characterized in that said anchoring or connecting step is performed by an upsetting operation which is preceded by a self-centered connection between said front ring or cover element and said cylindric band of the drum assembly.

Further features of the inventive method are clearly defined in the remaining dependent claims.

With respect to prior drum assemblies, the inventive drum assembly provides the advantage of allowing a mechanical direct connection of the wedge elements and front ring or cover element, i.e. a connection which does not comprise any welding spots favouring oxidation and sealing failure phenomena of the performed connection.

The mechanical sealing properties of the subject connection are moreover much more stable and efficient, than prior welding spot connections, since the subject connection is extended to the overall mutual coupling section of the wedge elements and corresponding portion of the front ring or cover element, and not to only a portion thereof, as in a spot welded connection.

The cold connection performed by upsetting a projecting portion of said front ring or cover element on the contour of a corresponding wedge element, furthermore, provides a self-centering effect. Thus, the drum assembling operation can be carried out a fully automatic manner due to the mutual engagement of the portions being connected, thereby providing a well finished final product.

BRIEF DESCRIPTION OF THE DRAWINGS

The above mentioned and yet other objects and advantages will become more apparent hereinafter from the following disclosure of a preferred embodiment of the drum assembly according to the present invention which is illustrated, by way of an exemplary but not limitative example, in the figures of the accompanying drawings, where.

DESCRIPTION OF THE PREFERRED EMBODIMENTS

Figure 1:
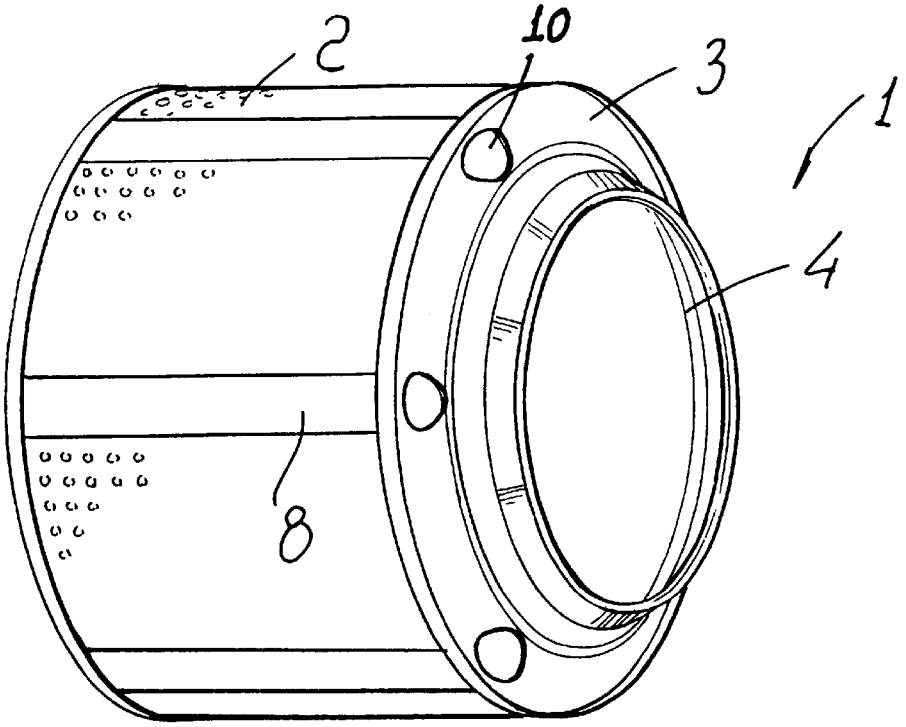
FIG. 1 is a general perspective view illustrating the drum assembly according to the present invention.

The drum assembly according to the invention has been generally indicated by the reference number 1 in FIG. 1 and is of a type suitable for application to washing, drying or the like machines. In this connection it should be pointed out that through the herein illustrated and shown example refers to a front loading type of drum assembly, the invention, also covers the so-called top loading drums. In the latter case, the front ring element will be replaced by a closing cover element and the perforated cylindric band will be provided with a mouth for allowing the linen to be washed and/or dried to be introduced into the drum.

Figure 2:
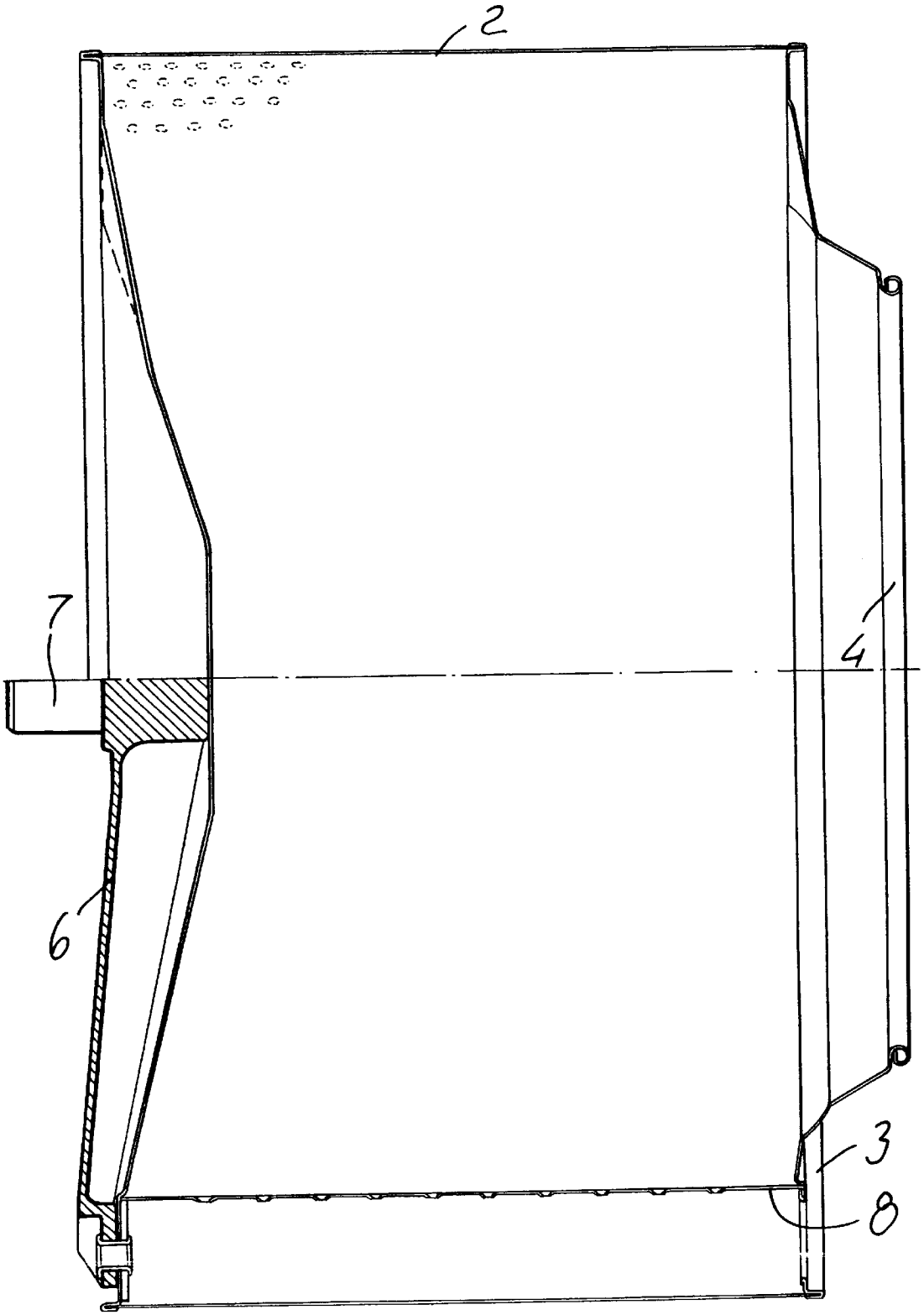
FIG. 2 is a partial cross-sectional view illustrating the drum assembly shown in FIG. 1.

The drum assembly 1 of FIG. 1, fully made of a stainless steel material (preferably chromium stainless steel AISI 430) comprises:

- a metal perforated band 2, forming the side cylindric wall of the drum assembly;
- a front ring element 3 provided with a loading mouth 4 for frontally loading the linen into the drum assembly 1; as stated, in a case of a side loading type of drum assembly, the ring element 3 will be replaced by a fully closed disc element (or provided with a mouth 4), whereas the band 2 will be provided with a linen loading door; and
- a bottom or closing disc 5 for closing the drum assembly 1 from the rear thereof, supporting a cross assembly 6 in turn bearing the shaft 7 for rotatively driving said drum assembly (FIG. 2).

On the band 2 of the drum assembly 1 are moreover integrally provided therewith entraining wedge elements 8. Said wedge elements, in particular, are formed by respective projecting or deformed portions of the band 2, extending to the inside of the drum, and operating for allowing the drum to properly engage or grip the linen.

Figure 3:
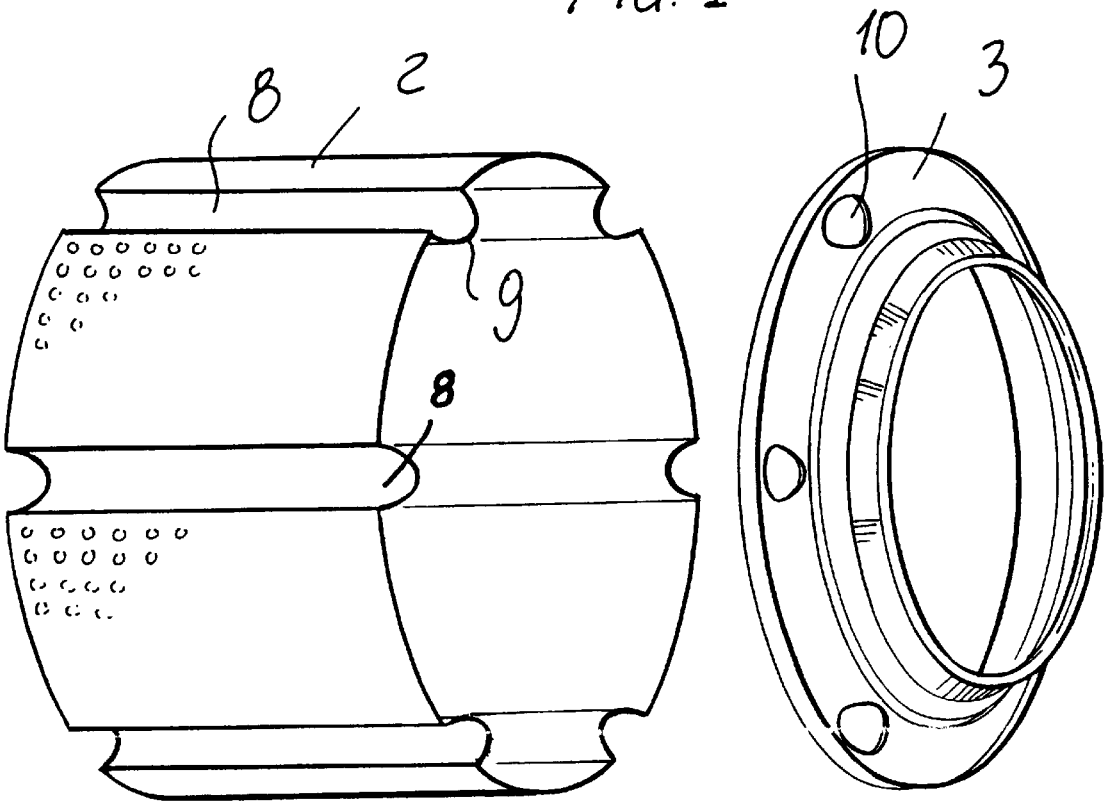
FIG. 3 illustrates the drum assembly shown in FIG. 1 during a preassembling operation in which the front ring element is preassembled on a perforated cylindric band.
Figure 4:
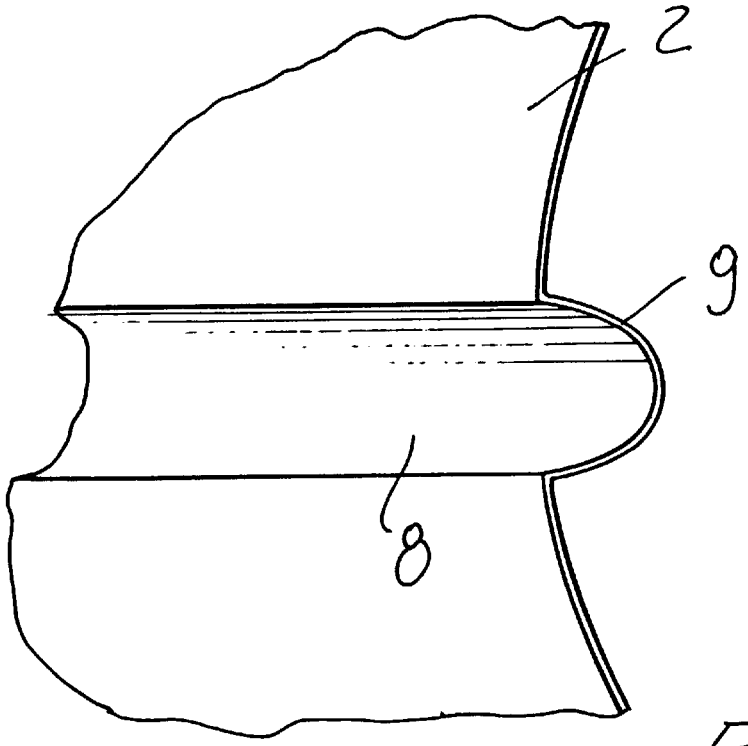
FIG. 4 illustrates a detail of the cross-section of a wedge element provided on the drum assembly of FIG. 3.
Figure 5:
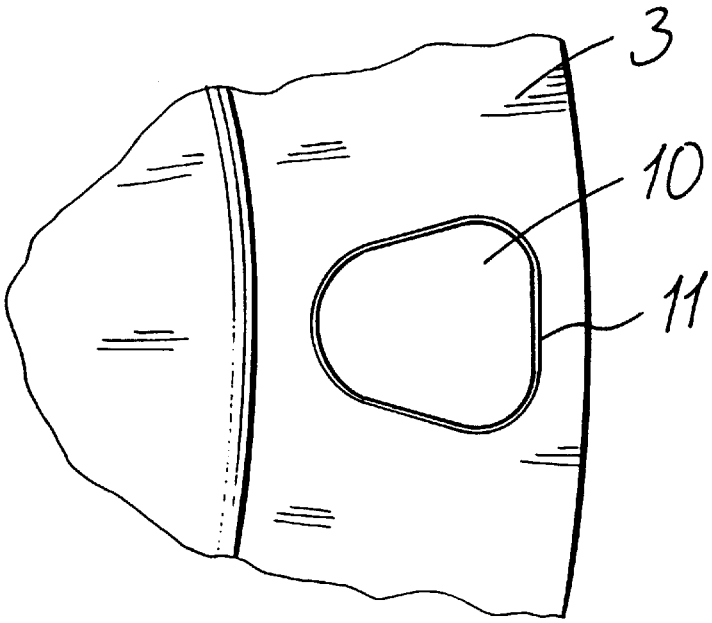
FIG. 5 illustrates a detail of a window provided through the ring element of FIG. 3.

As is clearly shown in FIGS. 3 and 4, that section of each wedge element 8 facing the ring 3 and provided for engaging with said ring element 3 is formed, before assembling, with an edge portion 9 formed by an inwardly turned wall of the wedge element, and parallel to the surface of the front ring element 3 (or substantially perpendicular to the axis of said wedge element). In turn the mentioned surface of the ring element 3 is provided, at each wedge element 8, with a window 10 clearly shown in FIG. 5. Said window is substantially formed by a hole having a contour corresponding to that of the projecting edge portion 9 of the respective wedge-element 8. Moreover, the cut contour or edge of the window 10 is so deformed as to provide a deformed portion 11 facing the inside of the drum assembly 1, i.e. a direction substantially perpendicular to the mentioned edge portion 9.

Figure 6:
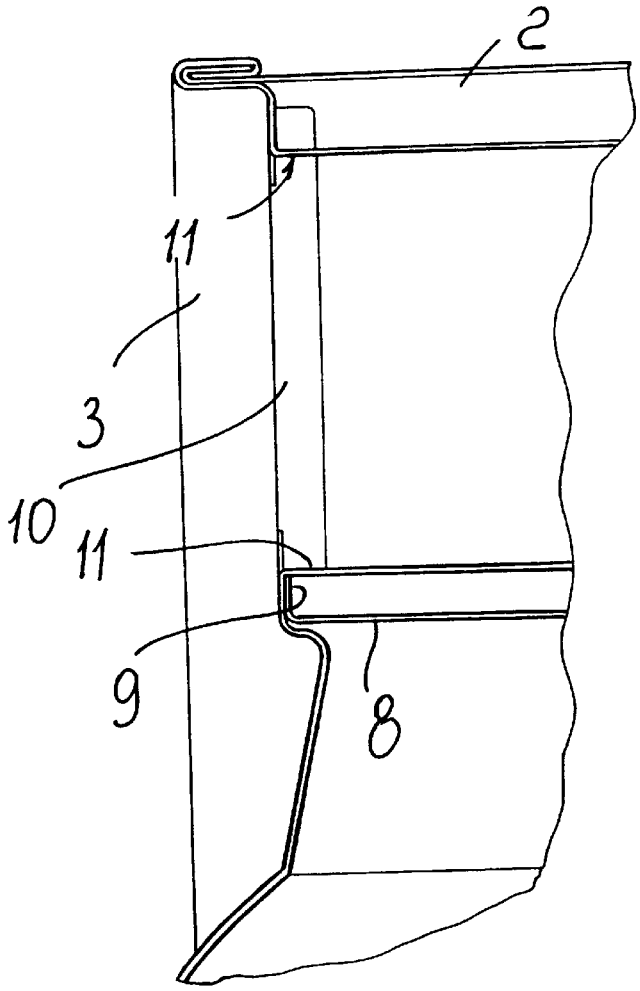
FIG. 6 illustrates the detail A of FIG. 2, in a ring element preassembling condition.
Figure 7:
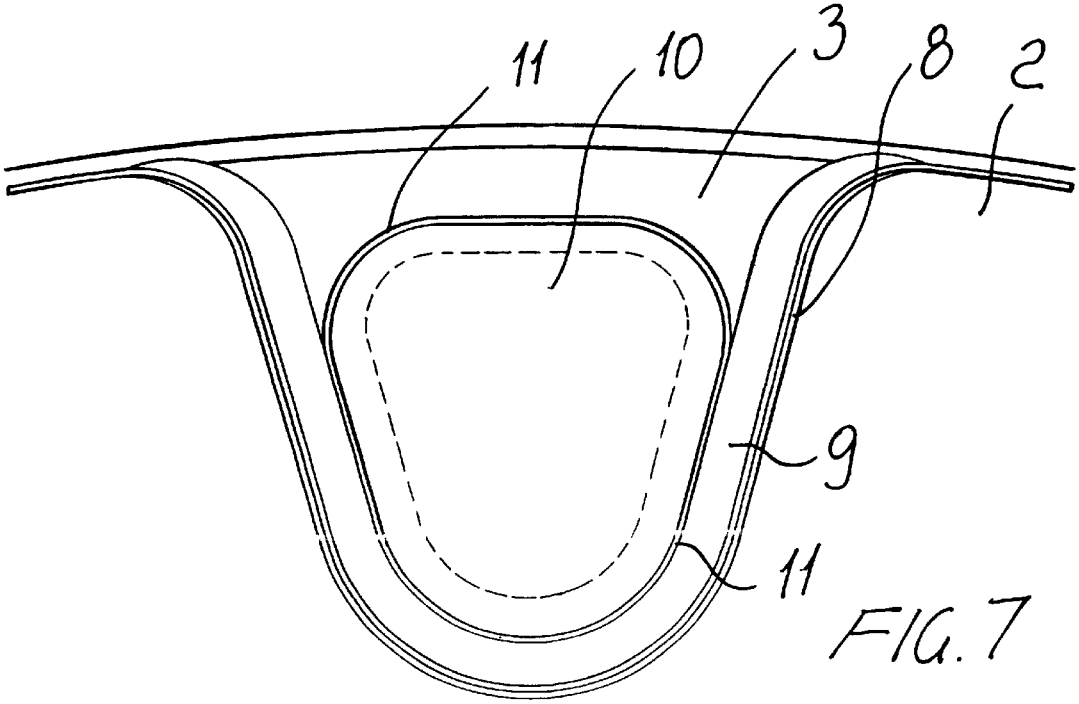
FIG. 7 is a top plan view illustrating the detail of FIG. 6.

The connection of the ring element 3 on the band 2, at the level of the wedge elements 8 and windows 10 is better shown in FIGS. 6 and 7. From said figures it should be apparent, in particular, that the ring element 3 is applied on the band 2 by engaging the deformed portion 11 of the windows 10 inside the respective wedge element 8, and arranging said deformed portion above said projecting edge portion 9 and transversely of the latter, thereby substantially bridging it (FIG. 6). During this operating step, the connection is obtained, in a centered manner, by causing the deformed portion 11 of the ring element 3 to abut against the contour of the edge portion 9 of the wedge element 8, which is arranged at substantially 90° with respect to said deformed portion. Said deformed portion 11, guided by the abutment on the edge portion 9, is shown in solid line in FIG. 7.

Figure 8:
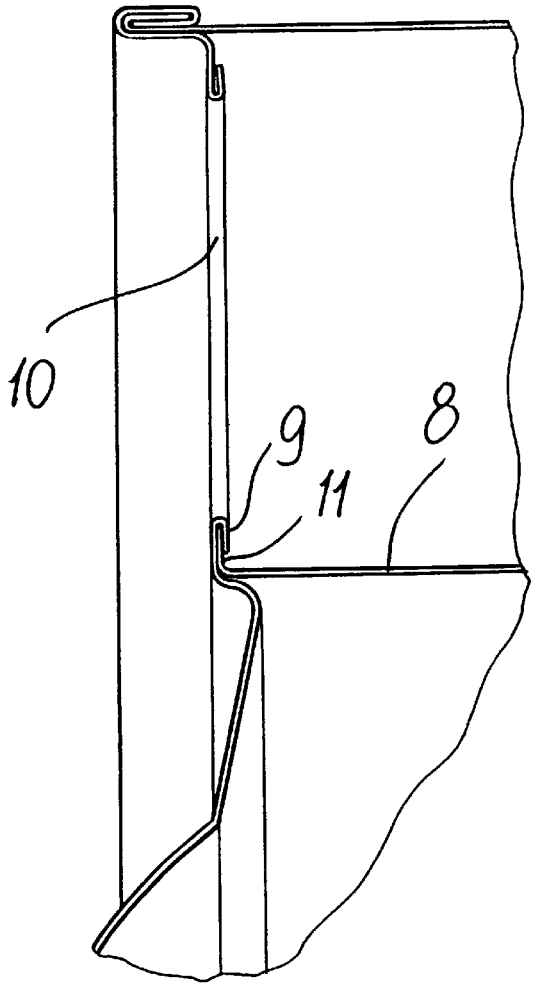
FIG. 8 illustrates the detail A of FIG. 2, at the end of the ring element assembling operation.
Figure 9:
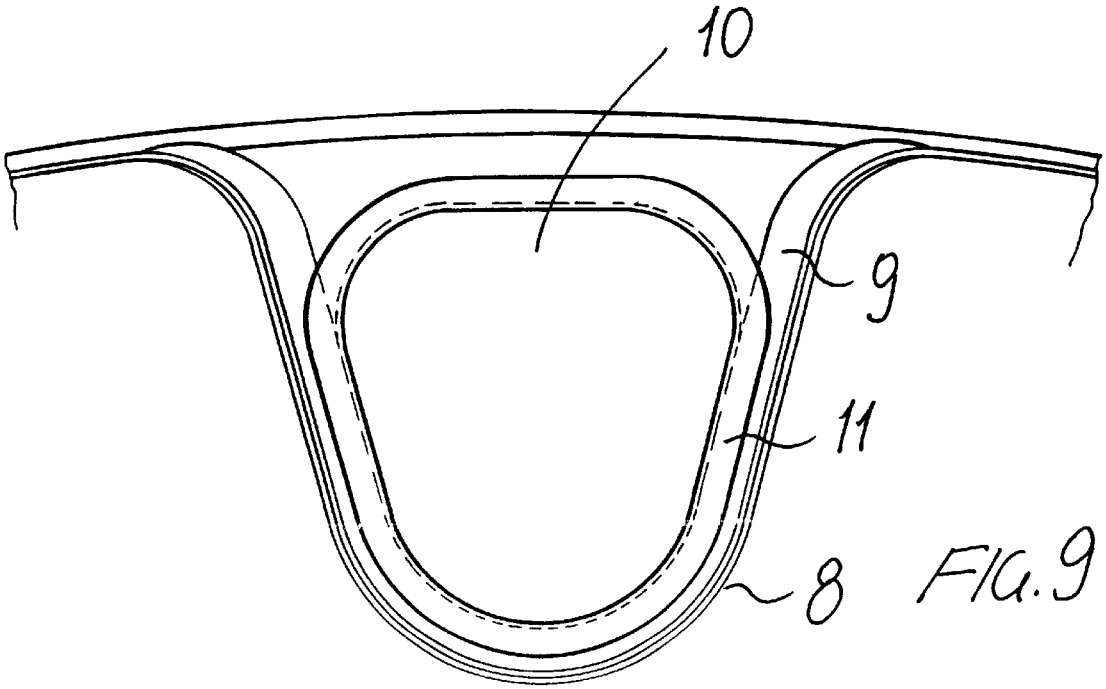
FIG. 9 is a top plan view illustrating the detail of FIG. 8.

Starting from the mentioned self-centered arrangement of said deformed portions 11 arranged inside the respective wedge elements 8, the mutual connection of the mentioned parts (and accordingly between the band 2 and ring element 3) is performed by upsetting each individual deformed portion 11 against the projecting edge portion 9 of the respective wedge element 8 (FIGS. 8 and 9). This operation, which is performed as a cold upsetting operation, causes the deformed portions 11 of the ring element 3 to be at first bent inwardly or rearwardly and then pressed against the projecting edge portion 9 of the respective wedge element 8. Thus, a broad sealing surface between the mentioned parts is obtained, corresponding to that of the deformed portion 11 bent above and pressed against the edge portion 9 of each wedge element 8 (which surface is clearly shown in FIG. 9).

According to a preferred embodiment thereof, the inventive method for making the improved drum assembly, which has been above disclosed, comprises the steps of:

providing a cylindric band 2 including a plurality of wedge elements 8 each having an edge portion 9 formed by an inwardly projecting wall of the wedge element, said wall being substantially transversely oriented of said wedge element, i.e. being perpendicular to the surface of said band 2;

providing a ring element 3 (or a front cover element) including a plurality of windows 10 at each wedge element 8, said windows being provided with a deformed portion 11 perpendicular to the ring element 3;

connecting the ring element 3 on the cylindric band 2 by engaging the deformed portions 11 inside the respective wedge elements 8, and arranging said deformed portions 11 above and substantially at 90° with respect to the related edge portion 9; and upsetting each deformed portion 11 against said edge portion 9, thereby causing said deformed portion to be rearwardly bent and pressed against the surface of said edge portion 9, thereby providing a gripping force thereagainst.

Figure 10:
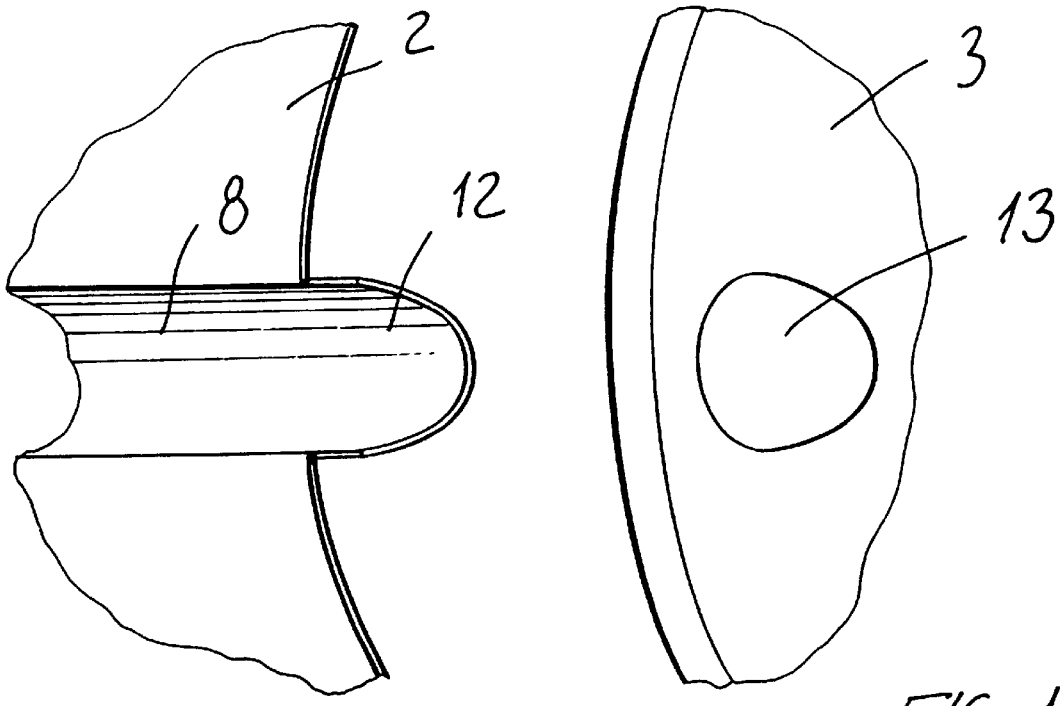
FIGS. 10 and 11 illustrate a modified embodiment of the drum assembly respectively shown in FIGS. 3 and 4.
Figure 11:
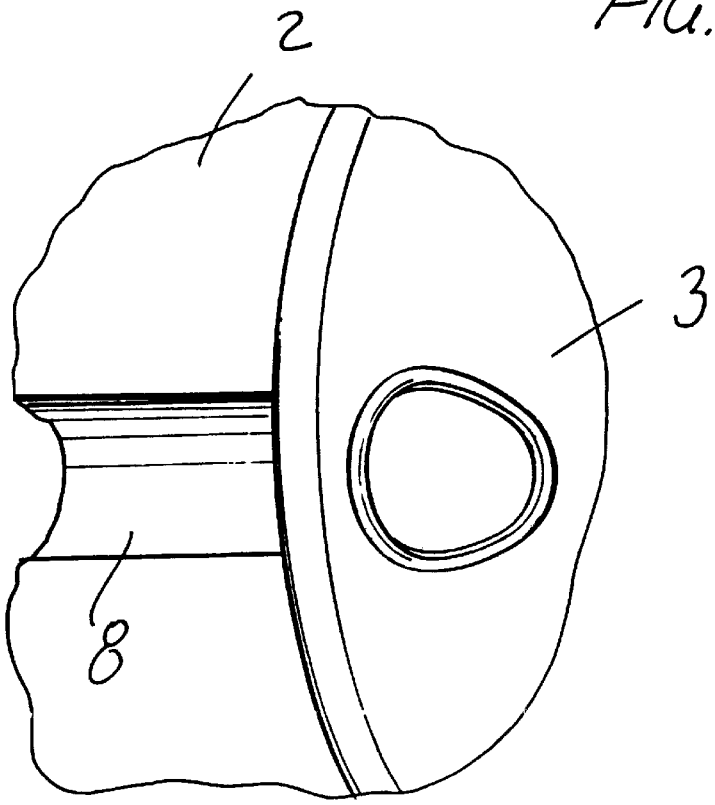

According to the modified embodiment shown in FIGS. 10 and 11, the wedge elements 8 are provided with a portion 12 outwardly axially projecting with respect to the band 2, to be engaged within the windows 13 of the front ring or cover element 3. In this modified embodiment, said windows are substantially analogous to the above disclosed windows 10, with the difference that they are free of any projecting deformed portions. The connection is in this case performed by upsetting the edge 12 of the wedge elements 8 inside the windows 13, by causing said edge to be at first rearwardly bent and then pressing it against the corresponding portion of the front ring or cover element 3 (FIG. 11).

The invention as disclosed and illustrated is susceptible to several modifications and variations which, however, will come within the scope of the accompanying claims.

Thus, for example, the engagement projecting wall 9 for engaging the wedge element 8 and ring element 3 can be replaced by a simple projecting rib, to be properly gripped by the mentioned upsetting of the deformed portion 11 of the ring element 3. Moreover, this can be obtained independently from the provision of the windows 10, said windows providing an essential function only with reference to the modified embodiment shown in FIGS. 10 and 11. Finally, the configuration or shape of the wedge elements 8 and windows on the front ring or cover element can be any depending on the designing requirements of the machine.

What is claimed is:

1. A method for making a drum assembly for washing and drying machines comprising the steps of:

providing a cylindric band including a plurality of wedge elements having and edge portion formed by a wall projecting toward an inside of a wedge element and substantially perpendicular to a surface of said band;

providing a ring element including a deformed portion projection from and perpendicular to said wall of said wedge elements; and urging said deformed portion against said wall, thereby pressing said deformed portion on said wall such that said deformed portion and said wall extend mutually parallel to form a broad sealing surface between said deformed portion pressed on said wall for forming a direct mechanical connection between said band and said ring element.

2. A method according to claim 1, characterized in that said deformed portion is made by bending an inner edge portion of a corresponding window formed on a surface of said ring element receiving a connection with a respective wedge element.

3. A method for making a drum assembly for washing and drying machines comprising the steps of:

providing a cylindric band including a plurality of wedge elements having an edge portion formed axially projecting toward an outside of a wedge element;

providing a ring element having windows at said edge portion of said wedge elements; and urging said projecting edge portion inside a corresponding window, thereby pressing said projecting edge portion against a contour of said corresponding window, thereby providing a direct mechanical connection between said band and said ring element.

4. A method for making a drum assembly according to claim 1, characterized in that said method comprises the step of cold clamping said ring element and said band, at said wedge elements of said band.

5. A method according to claim 4, characterized in that said cold clamping step comprises a press-deforming operation.

6. A method according to claim 4, characterized in that said cold clamping step is preceded by a connecting step in which said ring element is connected to said band.

7. A drum assembly for washing and drying machines, of the type comprising a cylindric band provided with a plurality of wedge elements facing an inside of said drum assembly, a rear closing disc and a front ring element, and connecting means for mechanically directly connecting said ring element and band, at said wedge elements of said band, said connecting means comprising a pair of mutually pressed and mutually parallel like extending mating parts of respectively said ring element and each of said wedge elements which together form a broad sealing surface between the mating and pressed parts.

8. A drum assembly according to claim 7, characterized in that said connecting means comprise projecting or raised portions each provided on an engagement section of each said wedge element with said ring element, and adapted to cooperate with corresponding projecting portions of said ring element.

9. A drum assembly according to claim 8, characterized in that said projecting portions comprise a wall formed on an end of each said wedge element facing said ring element and oriented toward the inside of said wedge elements at a position substantially parallel to a surface of the ring element on which said wall must be connected.

10. A drum assembly according to claim 9, characterized in that said projecting portions of said ring element comprise a deformed portion provided at a connection section on each said wedge element and having such a size and shape suitable for engagement inside each said wedge element, above and beyond said projecting wall.

11. A drum assembly according to claim 10, characterized in that said deformed portion comprises a wall oriented towards the inside of said drum assembly.

12. A drum assembly according to claim 11, characterized in that said deformed portion, after having performed the mechanical connection, is turned rearwardly and urged against said wall of the respective wedge element.

13. A drum assembly according to claim 12, characterized in that said deformed portion, is formed by a cut and upturned edge portion of a window formed through that portion of the surface of the ring element arranged at the level of each of said wedge elements.

14. A drum assembly according to claim 7, characterized in that said connecting means comprise a portion of said wedge elements axially projecting to an outside of said cylindric band, adapted to cooperate with corresponding window of said ring element, to be locked on the contour of said window.

15. A drum assembly according to claim 7, characterized in that instead of said ring element a closed covering element is provided and that a loading mouth for laterally introducing linen to be washed in said drum assembly is formed on said cylindric band.

* * * * *